US010870572B2

(12) United States Patent
Johnson et al.

(10) Patent No.: US 10,870,572 B2
(45) Date of Patent: Dec. 22, 2020

(54) BLENDING APPARATUS AND METHOD

(71) Applicant: Gilbarco Inc., Greensboro, NC (US)

(72) Inventors: Gordon W. Johnson, Stokesdale, NC (US); Christopher Adam Oldham, High Point, NC (US); Michael C. Liebal, Greensboro, NC (US)

(73) Assignee: Gilbarco Inc., Greensboro, NC (US)

( * ) Notice: Subject to any disclaimer, the term of this patent is extended or adjusted under 35 U.S.C. 154(b) by 105 days.

(21) Appl. No.: 15/797,428

(22) Filed: Oct. 30, 2017

(65) Prior Publication Data

US 2018/0044163 A1 Feb. 15, 2018

Related U.S. Application Data

(62) Division of application No. 14/713,743, filed on May 15, 2015, now Pat. No. 9,802,810.

(51) Int. Cl.
*B67D 7/04* (2010.01)
*B67D 7/78* (2010.01)
(Continued)

(52) U.S. Cl.
CPC ..... *B67D 7/78* (2013.01); *B67D 7/04* (2013.01); *B67D 7/423* (2013.01); *B67D 7/743* (2013.01);
(Continued)

(58) Field of Classification Search
CPC ..... B67D 7/78; B67D 7/423; B67D 7/744; B67D 7/743; B67D 7/04; B67D 2007/747
See application file for complete search history.

(56) References Cited

U.S. PATENT DOCUMENTS 4,876,653 A 10/1989 McSpadden et al.
4,978,029 A 12/1990 Furrow et al.
(Continued)

FOREIGN PATENT DOCUMENTS

EP 0961190 A1 * 12/1999 ..... G05D 11/13
WO 2009061573 A1 5/2009

OTHER PUBLICATIONS

Extended European Search Report dated Mar. 7, 2019 in corresponding European patent application serial No. 16796976.5, all enclosed pages cited.
(Continued)

*Primary Examiner* — Nicolas A Arnett
(74) *Attorney, Agent, or Firm* — Nelson Mullins Riley & Scarborough, LLP

(57) ABSTRACT

A method of delivering a selected fuel product having a selected octane level to an operator from a fuel dispenser including a blend manifold, a fuel nozzle, and a fuel hose extending therebetween, including the steps of determining a first volume of a first fuel that is retained in the fuel hose upon completion of a first fueling event, determining a first octane level of the first volume of the first fuel, determining a second volume of a second fuel having a second octane level, and delivering the first fuel volume and the second fuel volume to the operator during a second fueling event, wherein a total volume of fuel equaling the first volume of the first fuel and the second volume of the second fuel has a total octane level that falls within a predetermined limit of the selected octane level of the selected fuel product.

5 Claims, 5 Drawing Sheets

(51) Int. Cl.
*B67D 7/74* (2010.01)
*B67D 7/42* (2010.01)

(52) U.S. Cl.
CPC ..... *B67D 7/744* (2013.01); *B67D 2007/747* (2013.01)

(56) References Cited

U.S. PATENT DOCUMENTS 5,018,645 A * 5/1991 Zinsmeyer ..... B67D 7/425 222/132
5,029,100 A 7/1991 Young et al.
5,038,971 A * 8/1991 Gayer ..... B67D 7/744 222/1
5,125,533 A * 6/1992 Gayer ..... B67D 7/744 222/28
5,139,045 A 8/1992 Ensign
5,257,720 A 11/1993 Wulc et al.
5,390,713 A 2/1995 Feich
5,586,586 A 12/1996 Feich
5,630,528 A 5/1997 Nanaji
5,757,664 A 5/1998 Rogers et al.
5,956,254 A * 9/1999 Collins ..... B67D 7/744 222/1
5,975,353 A 11/1999 Finlayson
5,979,705 A 11/1999 Kaehler et al.
6,009,761 A 1/2000 Taylor et al.
6,065,638 A 5/2000 Terranova et al.
6,112,134 A 8/2000 Terranova et al.
6,161,060 A * 12/2000 Collins ..... B67D 7/744 700/236
6,163,738 A * 12/2000 Miller ..... B67D 7/744 222/132
6,223,788 B1 5/2001 Taylor
6,227,227 B1 5/2001 Poleshuk et al.
6,253,779 B1 7/2001 Nanaji et al.
6,422,465 B2 7/2002 Miller
6,505,134 B2 1/2003 Poleshuk et al.
7,523,770 B2 4/2009 Horowitz et al.
9,377,332 B2 6/2016 Carapelli
9,802,810 B2 * 10/2017 Johnson ..... B67D 7/04
2001/0001131 A1 5/2001 Miller
2004/0129726 A1 7/2004 Hutchinson
2011/0000579 A1 * 1/2011 Allinson ..... B67D 7/0498 141/9
2011/0094287 A1 4/2011 Nanaji et al.
2015/0153210 A1 6/2015 Bartlett et al.
2016/0332861 A1 * 11/2016 Johnson ..... B67D 7/04

OTHER PUBLICATIONS

International Search Report and Written Opinion dated Sep. 16, 2016 in corresponding international application serial No. PCT/US2016/032114, all enclosed pages cited.
Communication pursuant to Rule 164(1) EPC dated Nov. 27, 2018 in corresponding European patent application serial No. 16796976.5, all enclosed pages cited.
First Office Action issued by Chinese State Intellectual Property Office dated Apr. 2, 2019 in application serial No. 201680040757.0, all enclosed pages cited.
Second Office Action issued by Chinese State Intellectual Property Office dated Dec. 25, 2019 in application serial No. 201680040757.0, all enclosed pages cited.

* cited by examiner

BLENDING APPARATUS AND METHOD

CROSS-REFERENCE TO A RELATED APPLICATION

This application is a divisional of copending application Ser. No. 14/713,743, filed May 15, 2015, which is relied upon and incorporated fully herein by reference for all purposes.

FIELD OF THE INVENTION

The present invention relates generally to fuel dispensing systems for delivering fuels of a desired octane rating, the fuel being either a single fuel product of a given octane level or a blend of two or more fuel products of varying octane levels.

BACKGROUND OF THE INVENTION

Numerous dispensing systems exist for blending two or more fuels during a fuel dispensing event. Such systems are used quite often in a service station environment where it is desired to dispense a plurality of different grades or octane levels of fuel products by blending at least a high octane level product with a low octane level product to create one or more mid-level octane products. Blending systems offer the potential for savings stemming from reduced storage capacity requirements both at the service station and the bulk plant level. Such systems are also used for blending diesel fuels of varying cetane content levels, gasoline/ethanol fuels of varying ethanol content levels, and diesel/biodiesel blends of varying biodiesel content levels.

Often, these dispensing systems are based on an important underlying assumption, that the octane levels (or octane, ethanol, biodiesel levels) of the fuel products in the low and high octane fuel storage tanks, or more where present, are correct. For example, it is assumed that the low octane blend component has an octane of about 86 to 87 and that the high octane component has an octane level of about 92 to 93. However, due to various issues noted below, the actual octane levels of the fuel products may differ from what is expected.

A potential problem with many fuel blending systems is that they have no provision to detect the delivery of an incorrect octane level product in either the high or low level octane blending component storage tanks. Specifically, if the low octane product and/or high octane product are of different octane levels than the assumed octane rating, it may not be possible to deliver a proper octane blend during fueling operations.

Existing fuel dispensing systems are often prone to inaccuracy issues with respect to octane blend accuracy for small transaction dispensing events. Those inaccuracies can be due to a volume of blended fuel from the previous dispensing event being maintained in the fuel hose, the volume being defined between the blend manifold and fuel nozzle, which is the dispensed on the subsequent fueling event. This is typically only an issue where the octane ratings of the fuels for the two fueling events differ from each other. For example, where the selected octane ratings are the same for both events, the actual octane level of the retained volume from the first event should match the desired octane level selected by the operator for the fuel of the second event. However, where an octane level of the fuel dispensed in the previous fueling event is lower than the desired octane rating of the fuel dispensed in the subsequent fueling event, the lower octane level of the retained volume from the first fueling event causes the octane level of the overall volume of the fuel delivered in the second fueling event to be less than desired.

The present disclosure recognizes and addresses the foregoing considerations, and others, of prior art constructions and methods.

SUMMARY OF THE INVENTION

An embodiment of the present invention provides a method of delivering a selected fuel product having a selected octane level to an operator from a fuel dispenser including a blend manifold, a fuel nozzle, and a fuel hose extending therebetween. The method comprises the steps of determining a first volume of a first fuel that is retained in the fuel hose upon completion of a first fueling event, determining a first octane level of the first volume of the first fuel, determining a second volume of a second fuel having a second octane level, and delivering the first fuel volume and the second fuel volume to the operator during a second fueling event, wherein a total volume of fuel equaling the first volume of the first fuel and the second volume of the second fuel has a total octane level that falls within a predetermined limit of the selected octane level of the selected fuel product.

An alternate embodiment of the present invention provides a fuel dispensing installation which includes a first fuel tank containing a first fuel having a first parameter at a first level, second fuel tank containing a second fuel having the first parameter at a second level, a plurality of conduits connecting the first and second tanks to a fuel dispenser, said fuel dispenser having a blending system for blending the first and second fuels to form at least a first fuel blend having a third level of the first parameter, and a first and a second sensor operatively connected to the fuel dispenser so as to be in fluid communication with the first and second fuels, respectively, so as to sense the first level and the second level of the first parameter of the first and second fuels, respectively, and to output signals representative of the first level and the second level of the first parameter of the first and second fuels to the blending system, wherein the blending system receives the sensor output signals and generates output control signals to maintain the first parameter level of the first fuel blend within a predetermined range of the third level of the first parameter.

Another alternate embodiment of the present invention provides a method of delivering a selected fuel product having a selected level of a first parameter to an operator from a fuel dispenser including a blend manifold, a fuel nozzle, and a fuel hose extending therebetween, the method including the steps of determining a first volume of a first fuel that is retained in the fuel hose upon completion of a first fueling event, determining a first level of the first parameter of the first volume of the first fuel, determining a second volume of a second fuel having a second level of the first parameter, and delivering the first fuel volume and the second fuel volume to the operator during a second fueling event, wherein a total volume equaling the first volume of the first fuel and the second volume of the second fuel has a total level of the first parameter that falls within a predetermined limit of the selected level of the first parameter of the selected fuel product.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof to one of ordinary skill in the art, is set forth more particularly in the remainder of the specification, which makes reference to the accompanying figures, in which.

Figure 1:
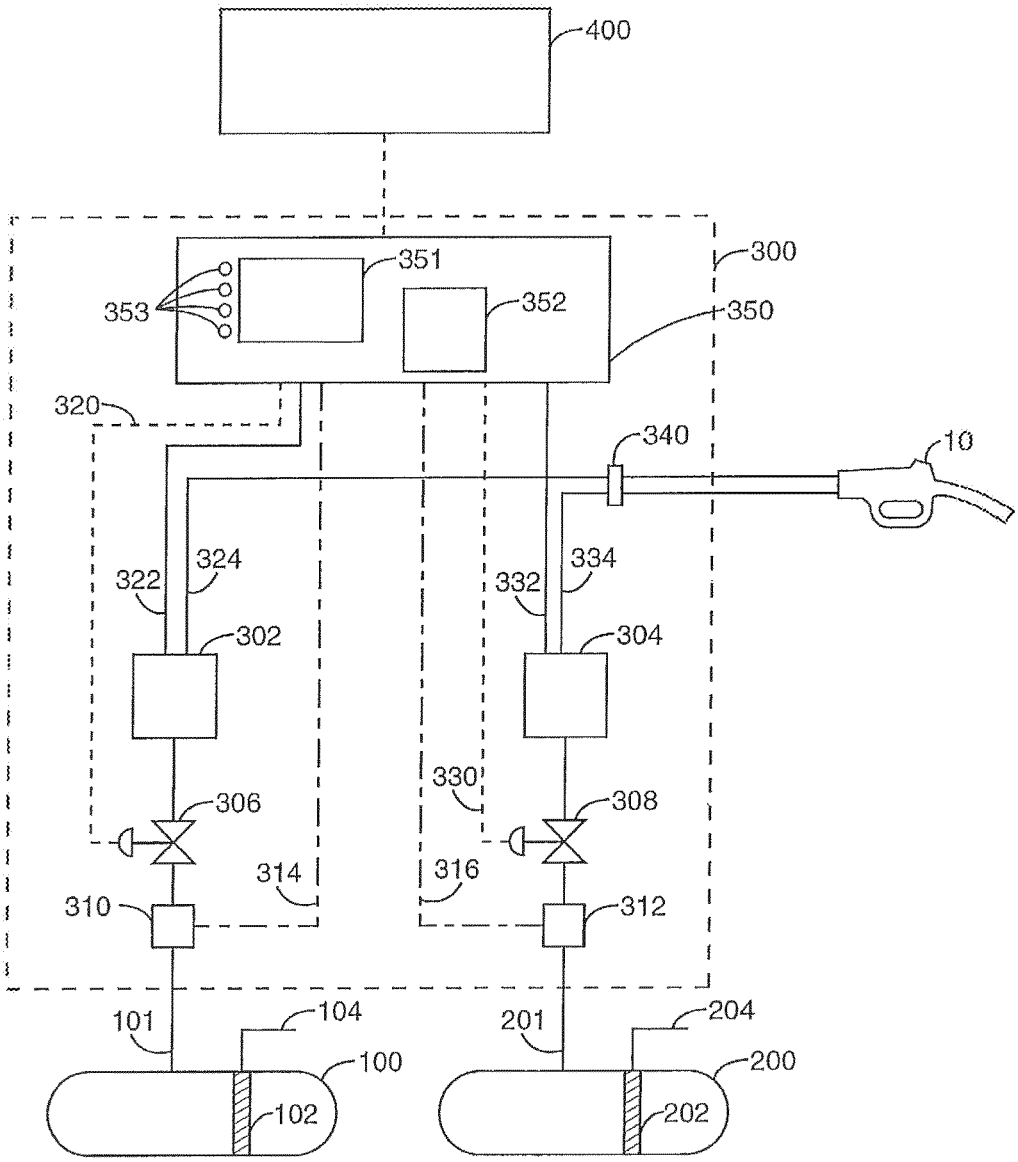
FIG. 1 is a schematic diagram of a fuel dispensing system in accordance with a first embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

An embodiment of a fuel dispenser 300 in accordance with the present invention is shown in FIG. 1 and includes a low octane product source 100 containing a low octane blend component, a high octane product source 200 containing a high octane blend component, and site controller 400 in electronic communication with fuel dispenser electronics 350. Site controller 400 provides means for operating personnel to monitor and control the operation of fuel dispenser 300 and the octane level in fuel sources 100,200. It should be understood that although only one fuel dispenser 300 is shown in FIG. 1, a typical installation would include several dispensers in fluid communication with each fuel source 100,200 and in electronic communication with site controller 400, as is well known in the art. Moreover, in alternate embodiments, octane blend components in addition to noted high and low octane blend components, i.e., midgrade octane blend components, may be utilized by fuel dispenser 300 in the blending process.

Fuel dispenser 300 is in fluid communication with product sources 100,200 via supply lines 101,201 and includes a customer display 351, an octane level display 352 and product blend selectors 353 for customer use to select the blended product desired for a particular transaction. The other components of fuel dispenser 300 include first and second real time octane sensors 310,312 for providing signals 314,316 indicative of the octane level of first and second products respectively. Note, in alternate embodiments, the octane sensors may be replaced by sensors for detecting cetane, ethanol, biodiesel content, etc., dependent upon the type of fuel being dispensed. First and second flow control valves 306,308 downstream of octane sensors 310, 312 control the flow rate of first and second products, respectively. First and second flow meters 302,304 connected to flow control valves 306,308 provide electronic signals 322,332 to dispenser electronics 350 indicative of the flow rate of a first and second products, respectively. Product flow lines 324,334 provide paths for delivery of each of the first and second products to blend manifold 340 and then to nozzle 10. As is well known in the art, nozzle 10 is connected to dispenser 300 via a flexible hose. First and second flow control valves 306,308 are controlled by dispenser electronics 350 via signal lines 320,330 respectively. Various other components such as fuel filters, check valves, solenoids and the like may also be provided as necessary.

Figure 2:
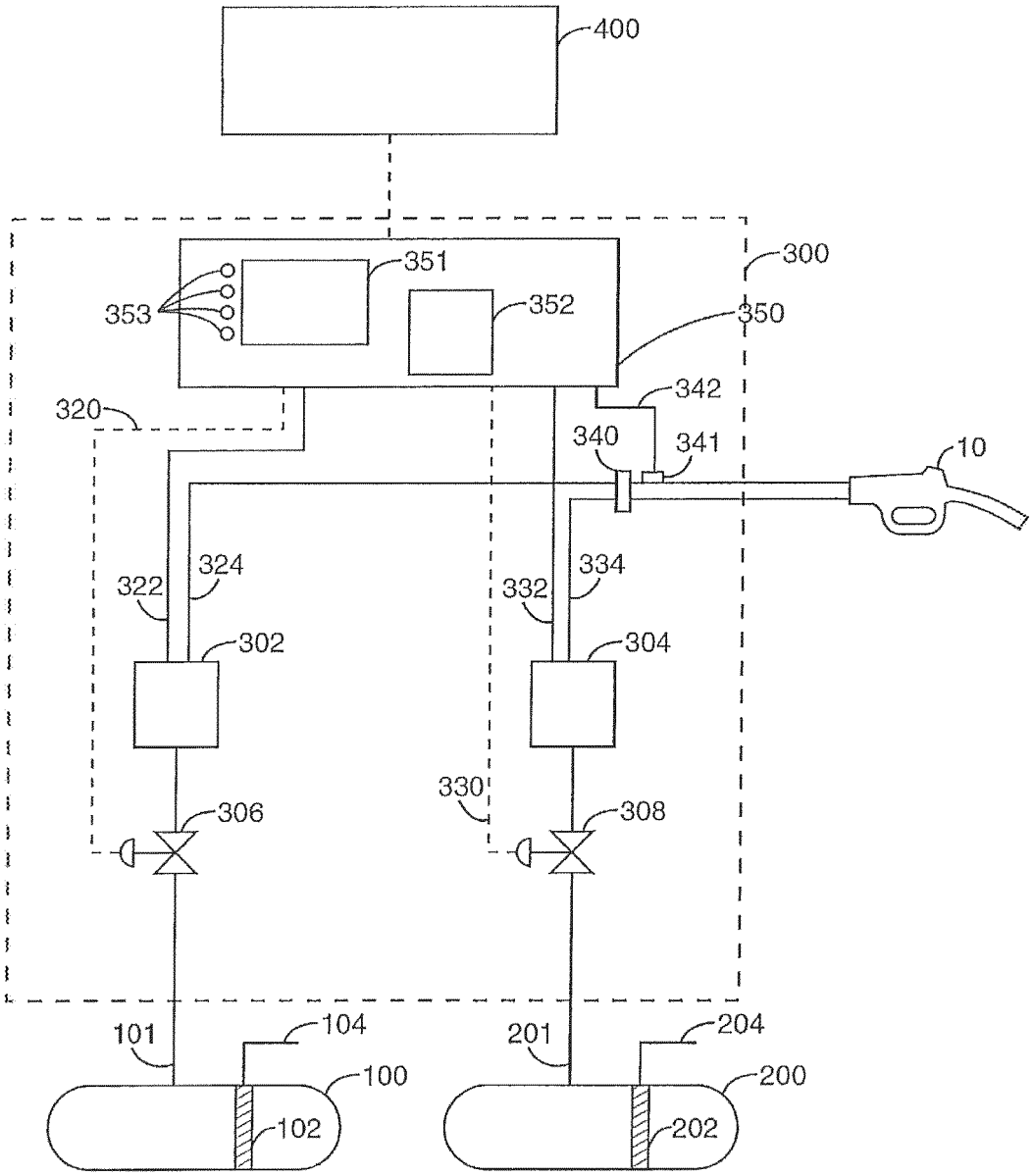
FIG. 2 is a schematic diagram of a fuel dispensing system in accordance with an alternate embodiment of the present invention.

An alternative embodiment of a fuel dispenser according to the present invention is shown in FIG. 2. This embodiment is the same as that shown in FIG. 1 except that only one octane sensor 341 is provided downstream of blend manifold 340. Sensor 341 provides an output signal 342 to dispenser electronics 350 indicative of the octane level of the blended product being provided by the dispenser. Note, in alternate embodiments, the octane sensors may be replaced with sensors for detecting cetane, ethanol, biodiesel content, etc. dependent upon the type of fuel being dispensed.

Either system described within FIGS. 1 and 2 may be provided with additional octane sensors 102,202 in product sources 100,200. These additional sensors can act as a backup to the dispenser-generated signals by providing output signals 104,204 to site controller 400 for monitoring the availability of suitable fuel blending components. Given their secondary, backup usage, these sensors need not be real time sensors as defined herein.

The term "real time octane sensor" as used herein means an octane sensing device capable of determining the octane level and transmitting a signal indicative of the octane level of a gasoline fluid to a dispenser controller or to some other device. The sensor must be capable of performing this function fast enough to enable the dispenser controller to correct a blending process continuously within the time span of a typical retail transaction. The scope of the present invention includes the use of currently known octane sensors and those that may be developed in the future so long as they meet this performance requirement.

Figure 3:
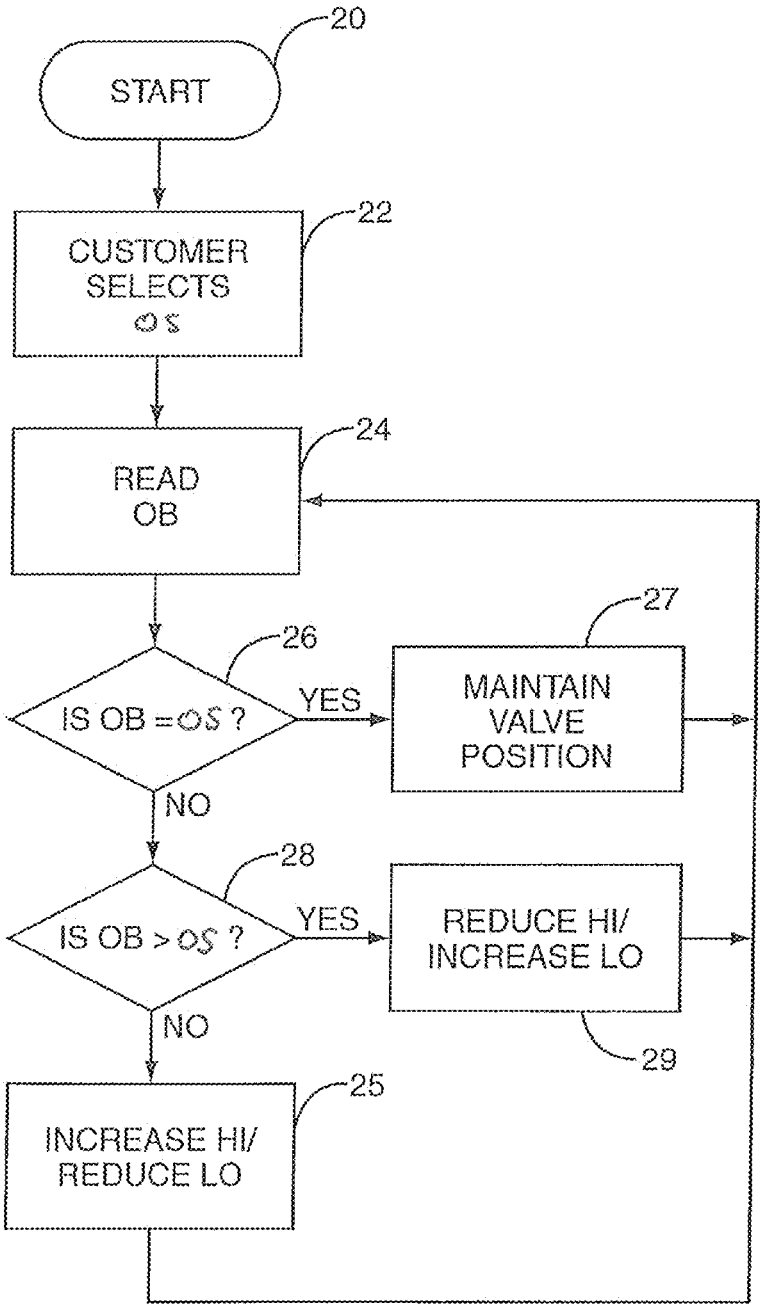
FIG. 3 is a flow chart illustrating a first embodiment for controlling a fuel blending process in a fuel dispensing system according to the present invention.
Figure 4:
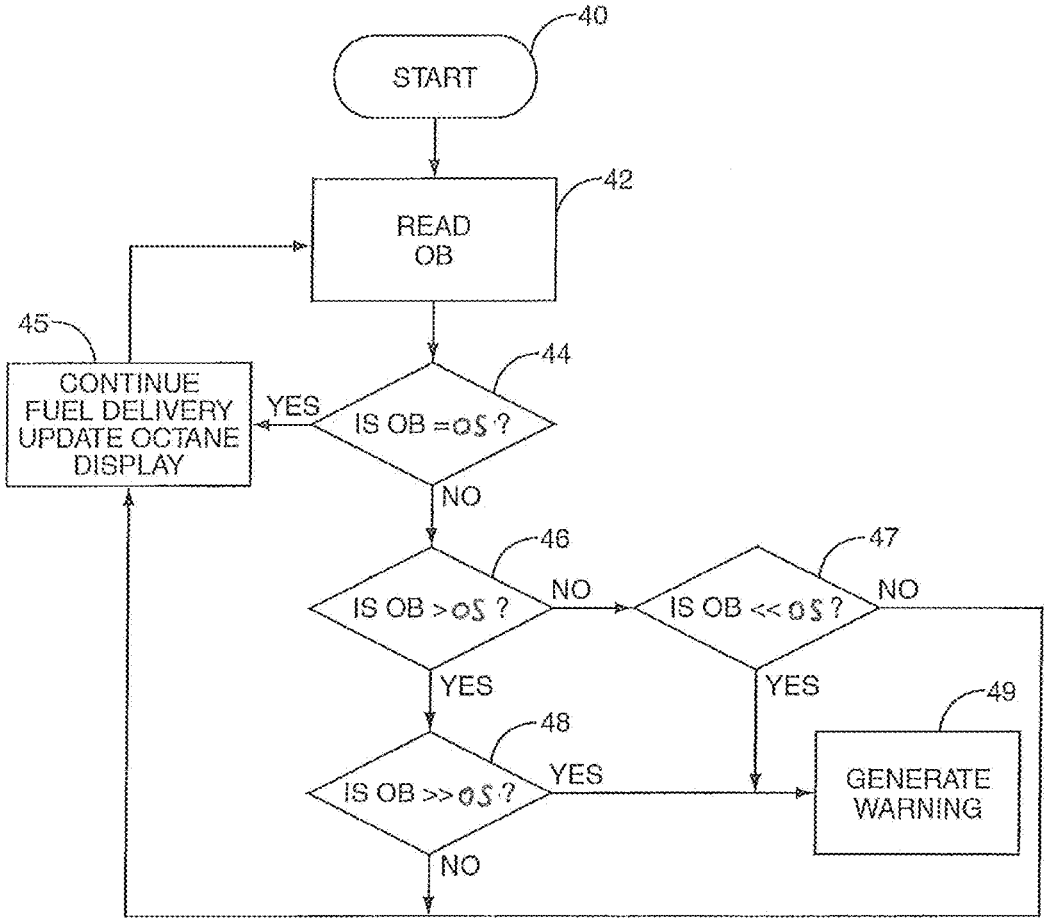
FIG. 4 is a flow chart illustrating an alternative embodiment for controlling a fuel blending process in a fuel dispensing system according to the present invention.
Figure 5:
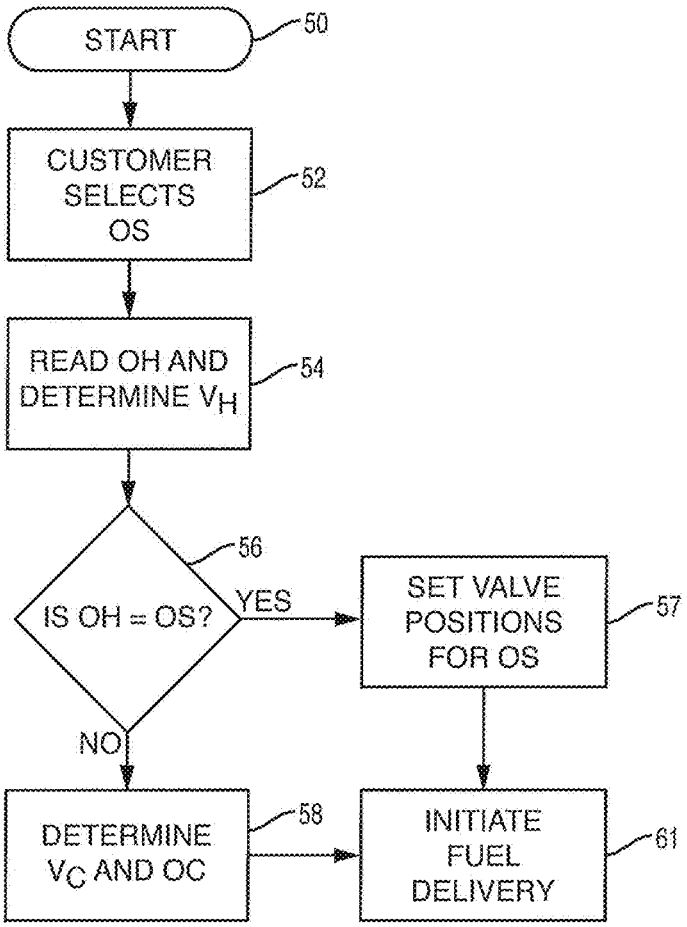
FIG. 5 is a flow chart illustrating an alternative embodiment for controlling a fuel blending process in a fuel dispensing system according to the present invention.

The flow charts shown in FIGS. 3 through 5 illustrate particular embodiments of using octane sensors in a fuel dispenser blending operation according to the present invention. Each of these embodiments may be described generally as a fuel dispenser installation including first and second fuel tanks 100,200 containing first and second fuels of differing octane levels, conduits 101,201 from first and second tanks 100,200 to a fuel dispenser 300. The fuel dispenser has a blending system for blending the first and second fuels to form a mixture having an intermediate octane. In alternate embodiments, more than the discussed first and second fuels may be utilized in the blending process. The installation further includes first and second octane sensors 102,202 to sense the octane levels of the first and second fuels and to output signals representative of those levels to the blending system such that the intermediate octane blend may be achieved using the measured octane levels.

Referring now to FIGS. 2 and 3, the blend control process is entered at 20 and proceeds to 22 where the customer selects the desired octane level (OS) of the fuel to be delivered. As used herein, "OS" refers to the octane level of the product selected by the customer. This product may be a low octane product or high octane product which may require no blending, or may be a mid-octane product which requires blending. In this example, a mid-octane product has been selected. Next, at step 24, as fuel delivery begins, dispenser electronics 350 read the octane level (OB) of the blended product using the blend octane sensor 341. As used herein, "OB" refers to the octane of the blended product leaving the dispenser as read by blend octane sensor 341. At test 26, (OB) is compared to (OS). If the two values are equal then the routine proceeds to 27 where flow control valves 306,308 are left in their current positions and the routine returns to 24 to read the octane level (OB) of the blended product again. It should be understood that at test 26 the values of (OB) and (OS) need not be identical to satisfy the test. There may be room for a small amount of variants between the two values while still satisfying the tests due to instrument error and as may be allowed by regulatory authorities.

If test 26 answers no, then the routine proceeds to test 28 where (OB) is again compared to (OS) to determine whether (OB) is greater than (OS). If this test answers yes, then the routine proceeds to 29 where flow control valves 306,308 are controlled to either reduce the amount of high octane blended component (HI) or increase the amount of low octane blending component (LO) making up the blended product. Either action may be used singly or in combination to correct the octane level (OB) of the blended product. If test 28 answers no, then the routine proceeds to 25 where flow control valves 306,308 are controlled to increase the amount of high octane blending component (HI) and/or reduce the amount of low octane blending component (LO) being supplied.

An alternative embodiment is described in the flow chart shown in FIG. 4. The process here starts at 40 and proceeds to 42 where dispenser electronics 350 read the output of blend octane sensor 341. At the same time, the octane level of the user selected product (OS) is read from a memory location. At test 44 (OB) is compared to (OS). If the two values are not equal the routine proceeds to test 46 where (OB) is again compared to (OS) to determine whether (OB) is greater than (OS). If this test answers no, then the routine proceeds to 47 where it is determined whether the value of (OB) is so far below that of (OS) as to exceed a predetermined limit. This difference between the values could relate to the tolerance and octane level permitted by regulatory authorities. If this test answers no, then the routine proceeds to block 45. If this test answers yes, then the routine proceeds to block 49 where a warning to operating personnel is generated. The routine could include the additional step at this point of stopping fuel delivery if (OB) is too far out of tolerance.

If the result of test 46 is yes, then the routine proceeds to test 48 where it is determined whether the value of (OB) exceeds the value of (OS) by a predetermined amount. If this test answers yes, then the routine proceeds to block 49 as described above. If this test answers no, then the routine proceeds to block 45 which permits the fuel delivery to continue but updates the octane display for the customer to show that an octane level higher than that selected is being provided. The system could also incorporate memory provided to record all occurrences of a higher octane product being dispensed than was actually selected. A record of such occurrences can be used by regulatory authorities to monitor blending performance and also may be used by operators to make appropriate adjustments.

Referring now to the flow chart shown in FIG. 5, a method by which the disclosed fuel dispensers 300 compensate for potential octane blend inaccuracies in small transaction dispensing events is discussed. The blend control process starts at 50 and proceeds to 52 where the customer selects the desired octane level (OS) of the fuel to be delivered. This product may be a low octane product or a high octane product which should require no blending, or may be a mid-octane fuel which requires blending. In the present example, a mid-octane product has been selected. Next, at step 54, prior to the initiation of the fueling event, dispenser electronics 350 read the octane level (OH) of the volume of fuel ($V_H$) that remains in the fuel hose of the fuel dispenser upon completion to the fueling event that directly preceded the present fueling event. In the embodiment of the fuel dispenser shown in FIG. 2, (OH) can be read by blend octane sensor 341 prior to the initiation of the fueling event. However, after initiation of the fueling event, blend octane sensor 341 provides information regarding (OB) of the blended product that is flowing through the fuel hose. Alternately, in the embodiment shown in FIG. 1, in which blend octane sensor 341 is not present, dispenser electronics 350 may retrieve the octane level selected in the preceding fueling event, or (OB) for that event, which was previously stored in memory. Note, the value of ($V_H$) will remain constant for a given length of fuel hose. As such, the value of ($V_H$) can be determined for a specific size fuel hose and entered into memory for later retrieval by dispenser electronics 350.

At test 56, (OH) is compared to (OS). If the two values are equal, then the routine proceeds to step 57 where flow control valves 306, 308 are set to the positions which correspond to octane level (OS), and the fuel dispensing event is initiated. In short, where the octane level of the fuel selected for the present event (OS) is the same as the octane level of the fuel delivered during the preceding event, and therefore the same octane level (OH) of the retrieved volume ($V_H$), there is no need to compensate for the portion of fuel that remained in the fuel hose ($V_H$) after the preceding event.

If test 56 answers no, then the routine proceeds to test 58 where dispenser electronics 350 determine a compensating volume ($V_C$) of fuel having an octane level (OC) dependent upon whether (OH) is greater than or less than (OS). If (OH) is greater than (OS), octane level (OC) of compensating volume ($V_C$), as determined by dispenser electronics 350, will necessarily be a lower octane level than (OH). ($V_C$) and (OC) may both vary, but are selected such that the combination of volumes of ($V_C$) having an octane level (OC) with retained volume ($V_H$) will result in a total volume of fuel ($V_T$) that has an octane level substantially equal to the octane level (OS) selected by the operator. Optionally, the value of ($V_C$) may be provided to the operator via display 351 to help insure that the operator dispenses enough fuel during the transaction to allow the selected (OS) to be attained. After ($V_C$) and (OC) are determined, the routine proceeds to step 61 where the dispensing of fuel is initiated, with volumes ($V_H$) and ($V_C$) being delivered prior to the remainder of the desired volume of fuel being delivered at the selected octane level (OS), in accordance with the methods previously discussed with regard to FIGS. 3 and 4.

If, on the other hand, test 56 determines that (OH) is less than (OS), octane level (OC) of compensating volume ($V_C$), as determined by dispenser electronics 350, will necessarily be a higher octane level than (OH). Again, ($V_C$) and (OC) may both vary, but are selected such that the combination of volumes of ($V_C$) having an octane level (OC) with retained volume ($V_H$) will result in a total volume of fuel ($V_T$) that has an octane level substantially equal to the octane level (OS) selected by the operator. As discussed above, after ($V_C$) and (OC) are determined, the routine proceeds to step 61 where the dispensing of fuel is initiated, with volumes ($V_H$) and ($V_C$) being delivered prior to the remainder of the desired volume of fuel being delivered at the selected octane level (OS), in accordance with the methods previously discussed with regard to FIGS. 3 and 4.

As alluded to above, equipment malfunctions such as internal meter leakage, meter calibration problems, valve failures and piping leaks can cause even a properly functioning prior art blending system to fail to deliver the desired octane level product. Certain aspects of the present invention may be incorporated into existing blending dispenser systems to address these situations. For instance, a blend octane sensor 341 may be provided for comparing the actual octane level of the blend to that selected by the customer. This information may be displayed to the customer during fueling as an assurance that the desired fuel grade is being delivered. If the actual octane level falls below that selected by the customer, dispenser electronics 350 can shut down the fueling operation and notify operating personnel via site controller 400.

It will be readily appreciated that the comparison steps described above encompass comparing a measured octane level not only to a single predetermined value but also to a range of values. Given the measurement error inherent in any instrument, it may be feasible to compare the measured octane value to determine whether it falls within a certain range of values. The scope of the present invention includes making the comparison steps described above using either a single point value or an octane range.

Historical information concerning the octane levels of both blending components and blended products may be stored in dispenser electronics 250, site controller 400 or other storage device for compliance monitoring by weights and measures authorities. These authorities may monitor octane levels from a remote location via a communications link with site controller 400. The advantages of such remote monitoring include reduced costs of compliance inspections and the ability to conduct unannounced monitoring checks on octane levels being delivered to the public.

The various components of the system described above may be combined in a variety of ways depending on the desired performance objectives. For example, if costs are a concern, dispenser 300 may be provided with only the blend octane sensor 341 and not with first and second octane sensors 310,312. The signal from blend octane sensor 341 is used by dispenser electronics 350 along with flow rate information from first and second meters 302,304 to generate output signals to flow control valves 306,308. In this embodiment, sensors on the inlet side of first and second meters 302,304 are not required. Conversely, octane monitoring may be conducted only on the inlet side of first and second meters 302,304 using first and second octane sensors 310,312 without monitoring the blended product. It will be readily apparent to one of ordinary skill in the art that octane level sensing may be incorporated into a dispenser blending process by either: 1) monitoring the octane level of the blended product without regard to the octane level of the incoming blend components or 2) monitoring the octane levels of the blend components without regard to the octane level of the blended product.

While preferred embodiments of the invention have been shown and described, modifications and variations thereto may be practiced by those of ordinary skill in the art without departing from the spirit and scope of the present invention, which is more particularly set forth in the appended claims. Specifically, the embodiments of the invention disclosed herein may be used when blending diesel fuels of varying cetane content levels, gasoline/ethanol fuels of varying ethanol content levels, and diesel/biodiesel blends of varying biodiesel content levels. In addition, it should be understood the aspects of the various embodiments may be interchanged without departing from the scope of the present invention. Furthermore, those of ordinary skill in the art will appreciate that the foregoing description is by way of example only, and is not intended to limit the invention as further described in such appended claims.

What is claimed:

1. A fuel dispensing installation, comprising:

a first fuel tank containing a first fuel having a first parameter at a first level;

a second fuel tank containing a second fuel having the first parameter at a second level;

a plurality of conduits connecting the first and second tanks to a fuel dispenser, said fuel dispenser having a blending system for blending the first and second fuels to form at least a first fuel blend having a third level of the first parameter to be delivered during a fueling event; and a first and a second sensor operatively connected to the fuel dispenser so as to be in fluid communication with the first and second fuels, respectively, so as to sense the first level and the second level of the first parameter of the first and second fuels, respectively, and to output signals representative of the first level and the second level of the first parameter of the first and second fuels to the blending system;

a third sensor located downstream of the blending system for detecting the third level of the first parameter of the first fuel blend during the fueling event, wherein the blending system receives the sensor output signals and generates output control signals to maintain the first parameter level of the first fuel blend within a predetermined range of the third level of the first parameter.

2. The fuel dispensing installation of claim 1, further comprising a display for displaying the third level of the first parameter of the first fuel blend to an operator.

3. The fuel dispensing installation of claim 1, wherein the first parameter is one of a cetane content, an ethanol content and a biodiesel content.

4. The fuel dispensing installation of claim 1, further comprising:

a first and a second valve in fluid communication with the first fuel and the second fuel, respectively, for independently controlling the flow rates of the first and second fuels; and a dispenser controller for receiving outputs from the first and second sensors and generating output control signals to first and second valves so as to maintain the first parameter of the first fuel blend at the third level.

5. The fuel dispensing installation of claim 4, wherein the first parameter is one of a cetane content, an ethanol content and a biodiesel content.

* * * * *